United States Patent [19]

Ludecke

[11] Patent Number: 4,573,317

[45] Date of Patent: Mar. 4, 1986

[54] DIESEL EXHAUST CLEANER AND REGENERATION BURNER SYSTEM WITH INDEXING PARTICULATE TRAP

[75] Inventor: Otto A. Ludecke, Rochester, Mich.

[73] Assignee: General Motors Corporation, Detroit, Mich.

[21] Appl. No.: 710,445

[22] Filed: Mar. 11, 1985

[51] Int. Cl.[4] ..... F01N 3/02

[52] U.S. Cl. ..... 60/303; 60/311; 55/272; 55/46; 55/DIG. 30

[58] Field of Search ..... 60/303, 311, 295; 55/283, 272, 466, DIG. 10, DIG. 30

[56] References Cited

U.S. PATENT DOCUMENTS

| | | | |
|---|---|---|---|
| 4,276,066 | 6/1981 | Bly | 60/311 |
| 4,359,864 | 11/1982 | Bailey | 60/311 |
| 4,478,618 | 10/1984 | Bly | 55/DIG. 30 |
| 4,481,767 | 11/1984 | Stark | 60/311 |

FOREIGN PATENT DOCUMENTS

| | | | |
|---|---|---|---|
| 1665 | 1/1979 | Japan | 422/180 |

*Primary Examiner*—Douglas Hart
*Attorney, Agent, or Firm*—Arthur N. Krein

[57] ABSTRACT

A diesel exhaust cleaner and regeneration system with indexing particulate trap for use with a diesel engine, as on a city bus, includes a housing means having a cylindrical intermediate housing, an exhaust inlet means at one end and an exhaust outlet at its opposite end with a shaft operatively journaled in the intermediate housing for rotation about the axis thereof and having one end thereof extending outboard of said exhaust inlet means to permit exterior rotation thereof. A cylindrical trap housing means is fixed to the shaft whereby it is sealingly and rotatably supported in the intermediate housing, the trap housing means including a plurality of circumferentially spaced apart filter supports located concentrically around the shaft with a particulate filter operatively supported in each of the filter supports. A fuel burner means is operatively fixed to the exhaust inlet means with the outlet end of the burner means located in operative axial alignment with one of the filters. A releasable detent means is operatively associated with the intermediate housing and with the trap housing means to permit rotative indexing of the particulate filters sequentially into operative alignment with the fuel burner means upon rotative movement of the shaft so that all of the filters can be sequentially regenerated.

2 Claims, 5 Drawing Figures

DIESEL EXHAUST CLEANER AND REGENERATION BURNER SYSTEM WITH INDEXING PARTICULATE TRAP

BACKGROUND OF THE INVENTION

This invention relates to diesel engine exhaust treatment systems, and, in particular, to an exhaust cleaner and regeneration burner system with indexing particulate trap for collecting and then incinerating particulates discharged in the exhaust gases from a diesel engine as used, for example, on intra-city buses or trucks.

DESCRIPTION OF THE PRIOR ART

It is known in the art to provide a diesel engine with an exhaust treatment system that includes one or more particulate traps or filters that are operative to filter out and collect particulates from the exhaust gas stream discharged from the engine. Such particulates consists largely of carbon particles that tend to plug the filter, thus restricting exhaust gas flow therethrough. Accordingly, after continued use of such a system for a period of time dependent on engine operation, it becomes desirable to effect regeneration of the particulate filter.

Restoration of such a particulate filter has been accomplished by the use of a suitable auxiliary heater or burner device. For example, as disclosed in U.S. Pat. No. 4,381,643 issued May 3, 1983 to Terrence L. Stark, a burner, having an air-fuel nozzle and an ignition device, can be used and operated, when desired, to heat the exhaust gases and the particulate filter to the combustion temperature of the collected particulates so as to burn them off the filter surfaces and, accordingly, to thus reopen the flow paths therethrough to again permit normal flow of the exhaust gases through that filter.

However, in such prior systems of the type, as disclosed in the above-identified U.S. Pat. No. 4,381,643, an onboard fuel pump and an air pump, such as an engine driven air pump, have been used to respectively supply fuel and air to the burner to effect the regeneration and such systems also require a suitable onboard control system, such as an electronic control unit, receiving input signals of various engine operating conditions and an input signal indicating, for example, the pressure differential existing across one or more particulate filters during engine operation is used to control the operation of the burner and the associate electric igniter to effect the required regeneration of the particulate filters during engine operation. Accordingly, such prior known systems are relatively expensive and add considerable dead weight to the vehicle on which it is used.

SUMMARY OF THE INVENTION

It is therefore a primary object of the invention to provide an improved exhaust cleaner and burner system for use on a diesel engine as preferably used on an intra-city bus or truck that advantageously utilizes an indexing particulate trap containing a plurality of particulate filters, with sufficient filter capacity to trap particulates during a full day of vehicle operation, that is operatively supported on a rotatable support whereby the particulate filters can be sequentially positioned in operative relationship to a single onboard regeneration burner system that is preferably adapted to be provided with fuel, air and electrical power from offboard sources during the daily servicing of the vehicle so as to effect regeneration of the particulate filters prior to the next day operational run of the vehicle.

For a better understanding of the invention, as well as other objects and further features thereof, reference is had to the following detailed description of the invention to be read in connection with the accompanying drawings.

DESCRIPTION OF THE PREFERRED EMBODIMENT

Figure 1:
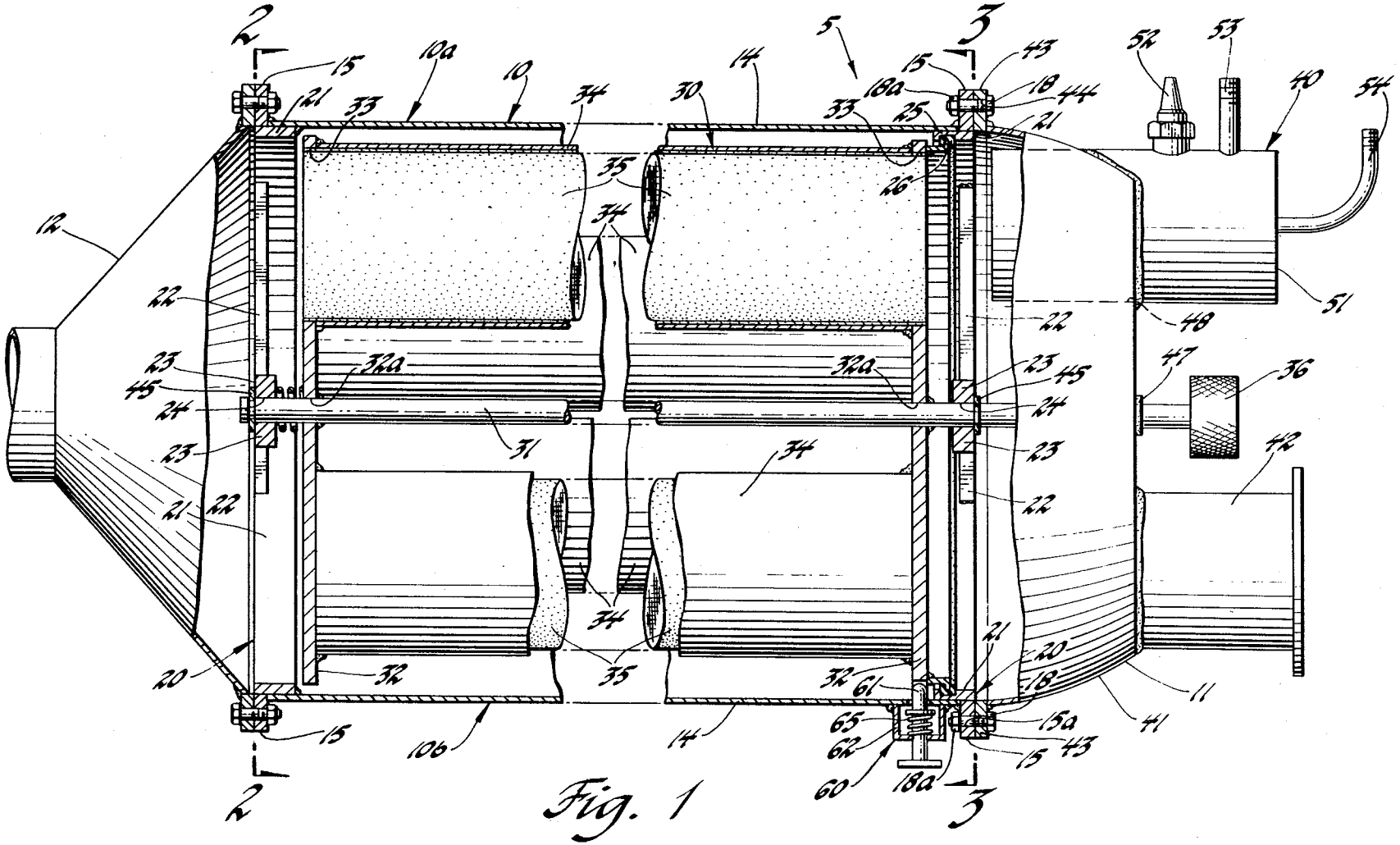
FIG. 1 is a schematic view, with parts in section, of a diesel exhaust cleaner and regeneration burner system in accordance with a preferred embodiment of the invention.

Referring first to FIG. 1 there is illustrated an exhaust cleaner and regeneration burner system with indexing particulate traps in accordance with the invention for use with a diesel engine as used in an intra-city bus or truck of the type that will be operated on a daily basis for a predetermined maximum number of miles before returning to a service area for servicing before the next day run.

The exhaust cleaner, generally designated 5, of the subject system in the construction shown is provided with a tubular housing that includes an intermediate housing 10 having an exhaust inlet 11 at one end and an exhaust outlet 12 at its opposite end.

Figure 2:
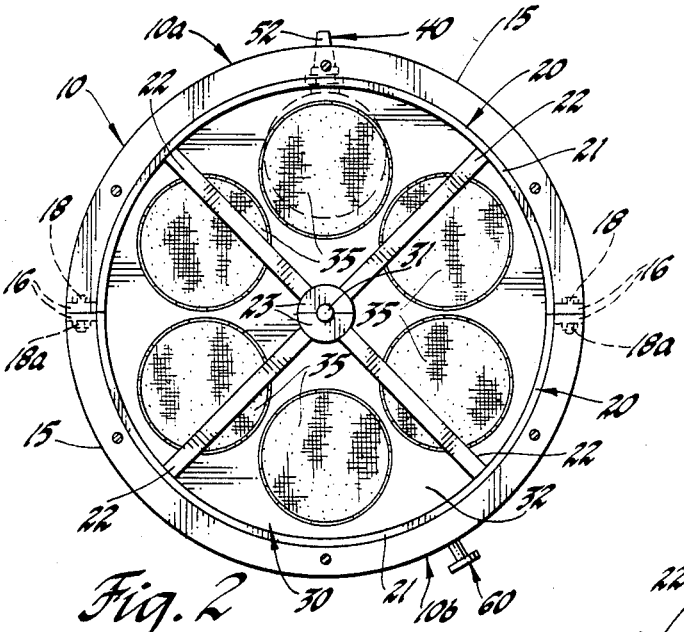
FIG. 2 is a cross sectional view taken along line 2—2 of FIG. 1 showing the exhaust end of the intermediate housing and of the trap housing assembly therein.

So as to facilitate the assembly of a trap housing therein, the intermediate housing 10, in the construction shown, is a multi-piece assembly that includes with reference to FIGS. 1 and 2, an upper and lower housing sections **10*a* and 10*b*, respectively. Since the upper and lower housing sections 10*a* and 10*b* are similar in construction, only the lower housing section 10*b*** is described in detail herein.

As best seen in FIGS. 1, 2, 3 and 5, the lower housing section **10*b* includes a semi-cylindrical shell 14, made of a suitable heat and corrosion resistant material, such as stainless steel, that has opposite ends thereof suitably fixed, as by welding, to a pair of semi-circular, radially outward extending flanges 15. Intermediate these flanges 15 the free longitudinal extending edges of the shell 14 are also suitably fixed, as by welding, to a pair of side flanges 16 that extend outward from the shell 14. As shown, the side flanges 16 are provided with spaced apart apertures 17 so as to permit the upper and lower housing sections 10*a* and 10*b* to be secured together as a unit assembly by suitable fastener means such as the bolts 18 and nuts 18*a* shown. As illustrated, the flanges 15 are also provided with spaced apart apertures 15*a* for flanged connection of the intermediate housing 10 to the exhaust inlet 11 and the exhaust outlet 12, as shown in FIG. 1**, in a conventional manner well known in the art.

The lower housing section 10*b* is also provided at opposite ends thereof with a pair of semi-circular shaft supports 20, each of which includes a semi-circular flat rim 21 by which the shaft support 20 is suitably fixed, as by welding, to the interior end surface of the shell 14, a plurality of spokes 22 that extend radially inward from the rim 21 and which terminate at and are fixed, as by welding, to a semi-cylindrical bearing hub 23. As best seen in FIG. 1, the mating sets of bearing hubs 23 of the upper and lower housing sections 10*a* and 10*b*, respectively, are provided with through axial bores so as to define bearing bore surfaces 24 of a predetermined internal diameter to rotatably support the support shaft 31 of a generally cylindrical indexing particulate trap housing, generally designated 30. In addition, a semi-circular ring-like seal member 25 having a groove 26 therein, which may be formed integral with the inlet end shaft support 20 or formed as a separate element secured, as welding, to the interior surface of the shell 14 inboard of inlet end shaft support 20, for a purpose to be explained in detail hereinafter.

Figure 3:
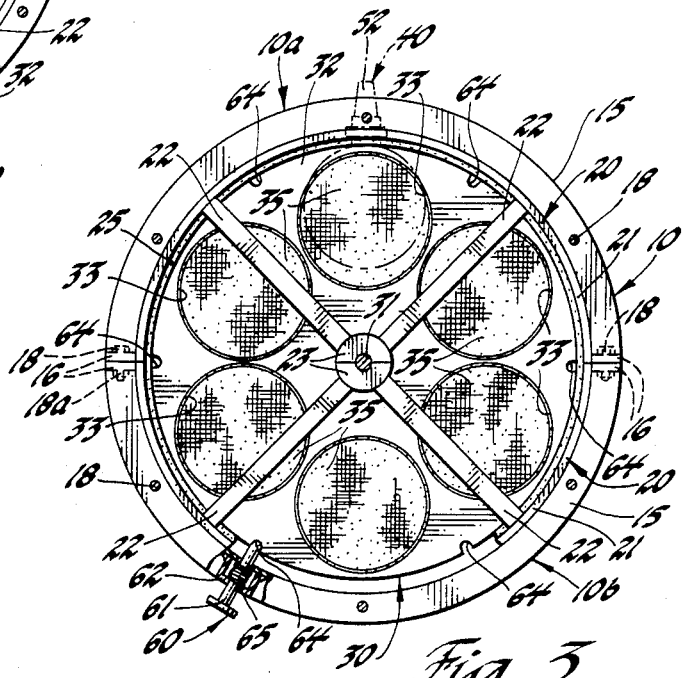
FIG. 3 is a cross sectional view taken along line 3—3 of FIG. 1 showing the inlet end of the trap housing rotatably supported and sealed within the intermediate housing.

Referring now to the trap housing 30, in the construction shown as best seen in FIGS. 1 and 3, it includes a pair of spaced apart, circular filter holder plates 32, each having a central aperture 32*a* therethrough to receive the support shaft 31 to which they are fixed, as by welding, for rotation therewith. In addition, each filter holder plate 32 is provided with a plurality of circumferentially spaced apart openings 33, six such openings 33 of circular configuration being used in the construction illustrated. Accordingly, in this construction, six tubular filter supports 34 are suitably secured, as by welding, at their opposite ends to the holder plates 32, with each such filter support 34 positioned so as to encircle an associate opening 33, as shown in FIG. 1.

Each of the filter supports is of a predetermined internal diameter, with also at least the opening 33 in the inlet end holder plate 32 being of a corresponding diameter, whereby a suitable particulate trap or filter 35 can be sealingly mounted therein in a conventional manner well known in the art. Preferably, the filters 35 are conventional, ceramic, wall flow, monolith filters of the type disclosed in U.S. Pat. No. 4,364,761 entitled "Ceramic Filters for Diesel Exhaust Particulates and Methods of Making", issued Dec. 21, 1982 to Morris Berg, Carl F. Schaefer and William J. Johnston.

It will be appreciated that, in accordance with the preferred operational embodiment of the invention, the shape, the outside dimension and axial extent of the filters 35 together with the filtering capacity of each filter and the number of such filters are preselected so as to provide for a total filter surface area that is adequate to permit the vehicle to operate for a predetermined, maximum number of miles on the usual normal day run of the vehicle, with no preplanned regenerations, so as to prevent the buildup of the backpressure across the filter to such a value that it could adversely effect engine operation.

However, in regard to the above, it would be apparent to those skilled in the art, that, if desired, the filters can be coated with a suitable catalyst as known in the art or, alternatively, such a catalyst material can be used as a fuel additive, whereby, so-called, spontaneous regeneration of individual filters 35 can occur during engine operation. As an example and as known in the art, such spontaneous regeneration can occur if a spark discharged in the exhaust gas from the engine lands on particulates previously trapped by the filter so as to cause spot ignition of those particulates. This initial flame can then propogate so as to effect regeneration of that filter.

As shown in FIG. 1, the particulate trap housing 30, with the filters 35 therein, is rotatably supported within the intermediate housing 10 by means of its shaft 31. As shown, the shaft 31 is rotatably journaled by the bearing bore surfaces 24 of the axially spaced apart sets of bearing hubs 23 of the shaft supports 20, with one end of the shaft 31, the right hand end with reference to FIG. 1, extending outward of the intermediate housing 10 and through the exhaust inlet 11, in the construction shown, so that its free end extends outboard of the exhaust inlet 11 to permit external rotation of this shaft 31. In the embodiment shown, the shaft 31 is adapted to be manually rotated as by means of a suitable means, such as a knob 36 suitably fixed to the outboard end of the shaft 31, as by a threaded connection between these elements. With this arrangement, the individual filter 35 can be brought into operational alignment with a burner device, generally designated 40, fixed to the exhaust inlet 11.

Referring now to the exhaust inlet 11, in the construction shown in FIG. 1, this exhaust inlet, starting from the left with reference to FIG. 1, includes a tubular transition member 41 having an outlet end portion corresponding in size and shape to that of the shell 14 and an inlet passage portion 42, these elements being suitably secured together, as by welding, into a unitary structure. The transition member 41 at its outlet end, the left hand end with reference to FIG. 1, is suitably secured, as by welding, to a ring mounting flange 43 having circumferentially spaced apart bolt receiving apertures 44 therethrough whereby the exhaust inlet 11 is secured to the intermediate housing 10 by bolts 18 which extend through the apertures 44 of the flange 43 and the flanges 15 for engagement with nuts 18*a*.

The transition member 41 is also provided with a suitable coaxial opening having a bearing/seal 47, to receive shaft 31, encircling it and suitably secured, as by welding, to the transition member 41 and an enlarged opening 48 of a size to receive the burner housing 51 of the burner assembly 40 that is also fixed, as by welding, to the transition member 41 at a location whereby the outlet end of the burner assembly 40 is operatively aligned and axially spaced relative to one of the filters 35 in the particulate trap housing 30.

The burner assembly 40, in the construction shown, is a conventional air-fuel mixing and atomizing type burner capable of supplying an atomized combustible air-fuel mixture used to supply the heat needed to raise the temperature of the particulates trapped on a filter 35 to their combustion temperature and to supply the additional air to the filter for the controlled incineration of the accumulated particulates on the filter. A suitable electric igniter 52, such as a spark plug, as shown, or a glow plug, is also operatively mounted to the burner housing 51 for igniting the air-fuel mixture supplied to burner assembly 40. In accord with the preferred embodiment, the electric igniter 52 is located so as to be connectable to an external, offboard, source of electrical power.

As will be apparent from the above comments, the burner assembly 40, in the preferred embodiment, includes a conventional air atomizing type fuel nozzle, not shown, having external fuel and air conduits 53 and 54, respectively, by means of which fuel and combustion air can be respectively supplied from a suitable offboard fuel pump and air pump, both not shown.

In order to permit the plurality of filters 35 in the particulate trap housing 30 to be sequentially moved into and held in operative relationship downstream of the discharge end of the burner assembly 40, there is provided a releasable detent means 60 operatively associated with the intermediate housing 10 and the particulate trap housing 30.

Figure 4:
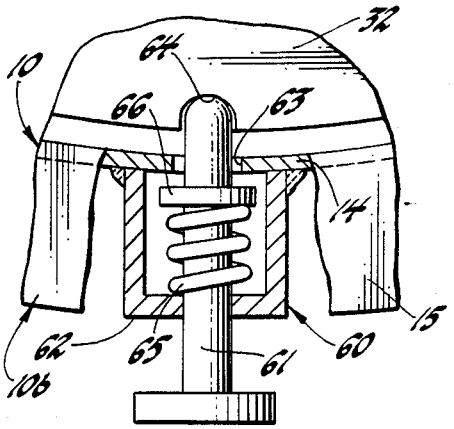
FIG. 4 is an enlarged view of the detent means per se of the exhaust cleaner assembly; and, FIG. 5 is a perspective view of the lower half of the intermediate housing per se.
Figure 5:
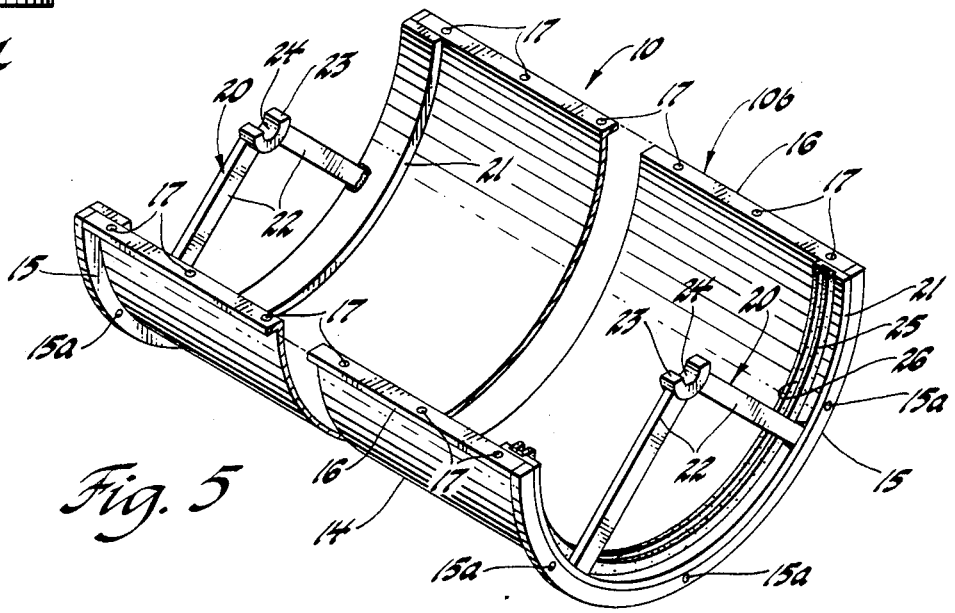

The releasable detent means 60, in the construction shown, is a manual operated type as best seen in FIG. 4, and as such, includes a detent plunger 61 slidably supported in a cup-shaped bracket 62 secured, as by welding, to the outer surface of the shell 14 of the intermediate housing 10 at a location whereby the inboard end of the detent plunger 61 can slidably extend through a side aperture 63 in the shell 14 for engagement into one of the plurality of circumferentially spaced apart detent notches 64 provided for this purpose in the outer peripheral surface of the inlet filter holder plate 32 of the particulate trap housing 30. Since six filters 35 are supported in the particulate trap housing 30 in the embodiment shown, six corresponding notches 64 are provided in this filter holder plate 32, with the notches being located radially outward and midway between adjacent filters 35 so that these filters can be sequentially rotated into operative alignment with the burner assembly 40, as shown in FIG. 1. In the construction shown, radial alignment between the detent plunger 61 and the notches 64 is maintained by fixing of the shaft 31 against axial movement by means of retainer rings 45 positioned in suitable grooves provided for this purpose in the shaft 31, as shown in FIG. 1.

The detent plunger 61 is normally biased in an axial direction for its engagement into a notch 64 by means of a spring 65 encircling the detent plunger with one end of the spring in abutment against the base of the bracket 62 and its other end in abutment against a spring retainer 66 suitably secured to the detent plunger 61.

Now in accordance with a preferred mode of operation, at the end of a day's run when the vehicle is returned to a service area for service, the service operator, in addition to refueling the vehicle, for example, can also effect regeneration of all of the filters 35 of the vehicle's exhaust cleaner system.

To effect such regeneration, the service operator would connect the electric igniter 52 to an offboard source of electrical power and would also connect the fuel conduit 53 and air conduit 54 to offboard sources of fuel and air, respectively, so that the burner device 40 would then be operative so as to initiate and continue the incineration of the particulates collected on the filter 35 then in operative relationship to the burner device, with or without operation of the engine.

After a predetermined period of time during which complete regeneration of that filter 35 will have occurred, the service operator will then manually temporarily release the detent plunger 61 and then begin rotation of the particulate trap housing 30 until the detent plunger 61 again engages into the next adjacent notch 64, thus effecting operational alignment of the next filter 35 with the burner device 40 to initiate regeneration of that filter. This procedure will then be repeated, as necessary, until all of the filters 35 have been regenerated, after which the offboard sources of electrical power, fuel and air can be disconnected from the electric igniter, fuel conduit 53 and air conduit 54, respectively.

While the invention has been described with reference to the structure and mode of operation disclosed herein, it is not confined to the specific details set forth, since it is apparent that many modifications and changes can be made by those skilled in the art. For example, it should now be apparent that the exhaust cleaner system of the invention could be automated for the rotative indexing of the filters into operative relationship with the burner device that can be actuated by means of onboard sources of electrical power, fuel and air so that regeneration of the filters can be accomplished during vehicle operation. This application is therefore intended to cover such modifications or changes as may come within the purposes of the improvements or scope of the following claims.

The embodiments of the invention in which an exclusive property or privilege is claimed are defined as follows:

1. An indexing particulate filter trap and regeneration system for use with a diesel engine as on a city bus, said system including a housing means having a cylindrical intermediate housing, an exhaust inlet means at one end and an exhaust outlet at its opposite end; a shaft operatively journaled in said intermediate housing for rotation about the axis thereof and having one end thereof extending outboard of said exhaust inlet means to permit exterior rotation thereof; a cylindrical trap housing means fixed to said shaft whereby said trap housing means is sealingly and rotatably supported in said intermediate housing, said trap housing means including a plurality of circumferentially spaced apart filter supports located concentrically around said shaft; a particulate filter operatively supported in each of said filter supports; a fuel burner means operatively fixed to said exhaust inlet means with the burner outlet end thereof in operative axial alignment with one of said filter supports; and releasable detent means operatively associated with said intermediate housing and with said trap housing means to permit rotative indexing of said particulate filters sequentially into operative alignment with said fuel burner means upon rotative movement of said shaft.

2. An indexing particulate filter trap and regeneration system for use with a diesel engine as on a city bus, said system including a housing means having a cylindrical intermediate housing, an exhaust inlet means at one end and an exhaust outlet at its opposite end; said intermediate housing having shaft support means at opposite ends thereof, a shaft operatively journaled in said shaft support means in said intermediate housing for rotation about the longitudinal axis thereof and having one end thereof extending outboard of said exhaust inlet means to permit manual rotation thereof; a cylindrical trap housing means fixed to said shaft between said support means whereby said trap housing means is sealingly and rotatably supported in said intermediate housing, said trap housing means including a plurality of circumferentially spaced apart filter supports located concentrically around said shaft; a particulate filter operatively supported in each of said filter supports; a fuel burner means operatively fixed to said exhaust inlet means with the burner outlet end thereof in operative axial alignment with one of said filter supports; and releasable detent means operatively associated with said intermediate housing and with said trap housing means to permit rotative indexing of said particulate filters sequentially into operative alignment with said fuel burner means upon rotative movement of said shaft.

* * * * *